United States Patent [19]

Sollinger

[11] Patent Number: 5,063,689

[45] Date of Patent: Nov. 12, 1991

[54] SINGLE WIRE DRYER GROUP WITH ADJUSTABLE REVERSING ROLLS

[75] Inventor: Hans-Peter Sollinger, Heidenheim, Fed. Rep. of Germany

[73] Assignee: J.M. Voith GmbH, Fed. Rep. of Germany

[21] Appl. No.: 550,621

[22] Filed: Jul. 10, 1990

[30] Foreign Application Priority Data

May 18, 1990 [DE] Fed. Rep. of Germany ..... 4015942

[51] Int. Cl.[5] ..... F26B 11/02

[52] U.S. Cl. ..... 34/115; 34/117; 34/118

[58] Field of Search ..... 34/113, 114, 116, 117, 34/123, 23; 162/193, 194, 260, 286

[56] References Cited

U.S. PATENT DOCUMENTS

| | | | |
|---|---|---|---|
| 3,263,344 | 8/1966 | Stickle | 34/116 |
| 4,000,035 | 12/1976 | Schiel et al. | 162/290 |
| 4,477,983 | 10/1984 | Andersson et al. | 34/117 |
| 4,481,723 | 11/1984 | Vedenpää | 34/116 |
| 4,505,052 | 3/1985 | Osswald et al. | 34/116 |
| 4,539,762 | 9/1985 | Eskelinen et al. | 34/116 |
| 4,566,946 | 1/1986 | Koponen et al. | 34/117 |
| 4,677,763 | 7/1987 | Kotitschke et al. | 34/117 |
| 4,686,778 | 8/1987 | Kotitschke et al. | 34/117 |
| 4,694,587 | 9/1987 | Eskelinen | 34/116 |
| 4,918,836 | 4/1990 | Wedel | 34/116 |
| 4,970,805 | 11/1990 | Wedel | 34/116 |

FOREIGN PATENT DOCUMENTS 8300514 8/1981 Fed. Rep. of Germany .

*Primary Examiner*—Henry A. Bennett
*Assistant Examiner*—Denise L. F. Gromada
*Attorney, Agent, or Firm*—Ostrolenk, Faber, Gerb & Soffen

[57] ABSTRACT

A single wire dryer group for a web producing, and particularly a papermaking, machine. A plurality of heatable drying cylinders arrayed in a row. A respective suction reversing roll is disposed between adjacent drying cylinders. An endless support belt for the web to be dried travels alternately over a drying cylinder over the next adjacent reversing roll and then over the next adjacent drying cylinder. Movable bearings support each of the reversing rolls so that the distance between the reversing roll and at least the preceding drying cylinder in the path of the belt is variable. The direction of motion of the berarings is parallel to the central plane joining the axes of the two drying cylinders adjacent the respective reversing roll. The reversing roll has an initial normal position closer to the preceding web supplying drying cyinder and further from the following web receiving drying cylinder. The bearings are selectively also movable over a large distance from the respective adjacent drying cylinders. An air blast box blows upon the web on the support belt passing over the reversing roll.

20 Claims, 1 Drawing Sheet

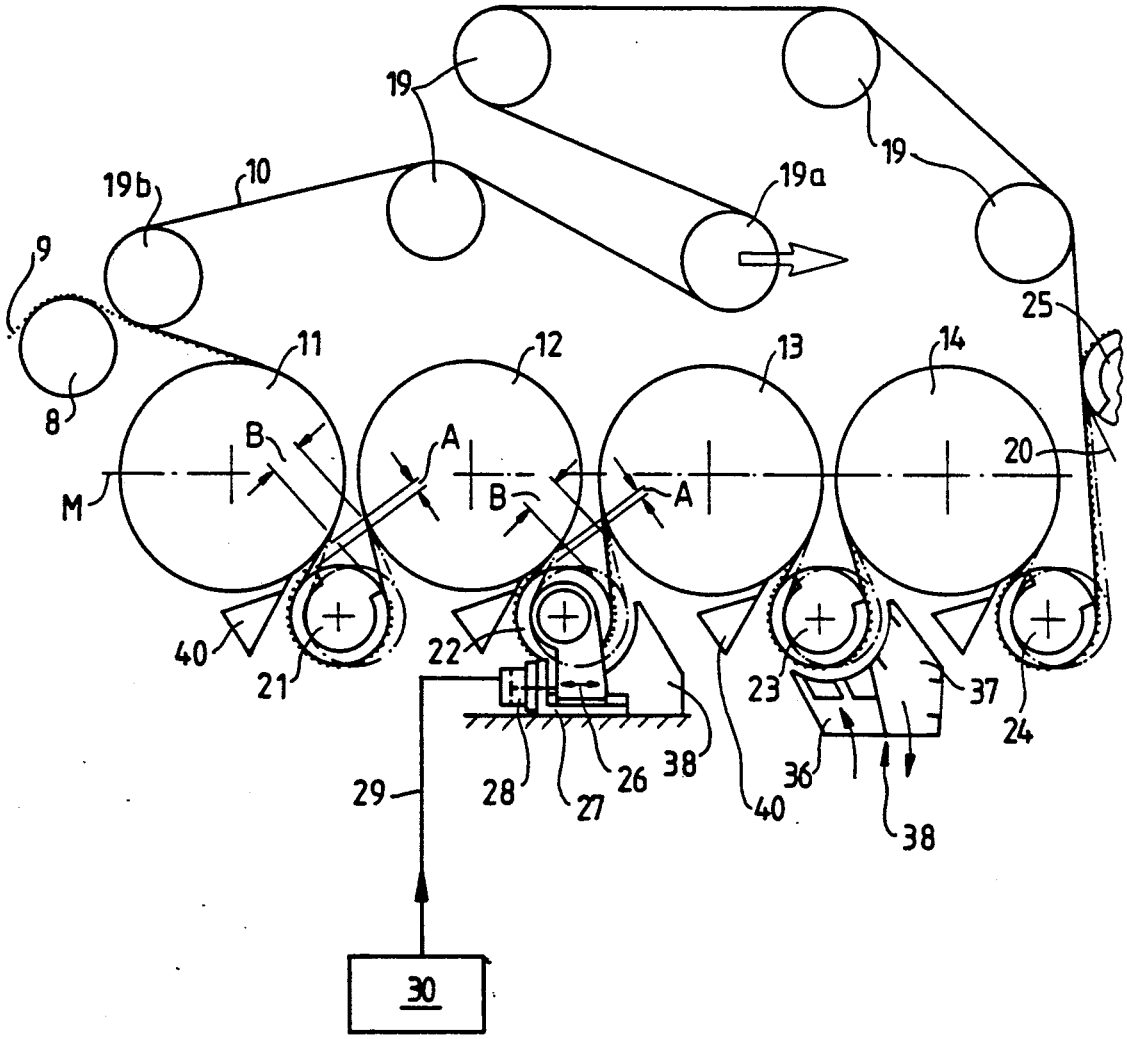
19
19
19a
19b
10
9
8
11
12
13
14
25
20
M
B
A
B
A
40
21
22
23
37
24
29
28
27
26
38
36
40
38
30

SINGLE WIRE DRYER GROUP WITH ADJUSTABLE REVERSING ROLLS

BACKGROUND OF THE INVENTION

The present invention relates to a single wire dryer group having a plurality of heatable drying cylinders and having at least one respective reversing roll disposed between two adjacent drying cylinders. The invention particularly relates to the adjustability of the reversing rolls. A support belt for the web to be dried, particularly an endless support belt or dryer wire, travels along a pathway which passes over a drying cylinder, then over a reversing roll and then over the next drying cylinder, and so on through the dryer group.

Published International specification WO 83/00514 discloses a single wire dryer group in which the distances between the drying cylinders and the neighboring reversing rolls, which are preferably suction guide rolls, can be very small in order to reduce as much as possible the elongation or tensile stressing of the web of paper, and thus to also reduce the crosswise contraction of the web upon departure of the web from each of the drying cylinders. That reference discloses supporting the reversing rolls in movable bearings so that the introduction of a new drying wire by means of transverse bars is possible. Another advantage is that there is no danger to the rolls or bearings if the web of paper should wrap up on one of the drying cylinders in the event that the web of paper tears.

In accordance with FIG. 2 of the above reference, the reversing rolls are so mounted on a swing lever that, when the drying cylinders are arranged in a horizontal row, the reversing rolls can be moved in the vertical direction away from the drying cylinders or back into their original positions.

A similar construction is disclosed in U.S. Pat. No. 4,905,379. One disadvantage of this construction is that upon each displacement of a reversing roll, the wire tensioning roll must be moved over a relatively large distance. This movement of the wire tensioning roll can generally take place only at slow speed. Thus, the process of displacing the reversing roll also always takes place very slowly. There is the additional disturbing factor that, at times, several reversing rolls of the same dryer group must be displaced simultaneously. Accordingly, the wire tensioning roll must then be moved over an even larger distance.

A drying end or dryer group with rigidly mounted reversing rolls is also known from Federal Republic of Germany Utility Model 9001210, corresponding to U.S. application 467,788, filed Jan. 19, 1990, in which the distance between the periphery of a reversing roll and the periphery of the preceding web delivering drying cylinder is less than the distance between the periphery of that reversing roll and the periphery of the following web receiving drying cylinder. The reversing roll is therefore arranged asymmetrically with respect to the two adjacent drying cylinders. On the one hand, the web of paper remains adhering relatively reliably on the support belt or drying wire at the point of its departure from the web delivering cylinder. This results, as already mentioned, in reduction in the longitudinal stretching of the web. On the other hand, an enlarged zone is obtained between the reversing roll and the web receiving cylinder. Within that zone, water vapor can emerge from the web of paper. An air blast box can also be arranged in that zone. This proposal has the disadvantage that the distance between the reversing roll and the preceding web delivering cylinder can still not be made sufficiently small since the reversing rolls are installed in fixed positions. That distance amounts to between 30 mm and 100 mm.

SUMMARY OF THE INVENTION

The object of the invention is to improve the single wire dryer group described above so that the distance between the upstream web delivering cylinder and the following reversing roll in normal operation can be made extremely small and so that, at the same time, the reversing roll is movable so that the wire tensioning roll need not be moved, or need be moved only slightly, upon displacement of the reversing roll.

The drying cylinders are arranged one after the other. They may be in a horizontal row, but any other configuration over which the endless support belt can pass would suffice. At least one respective reversing roll is positioned between adjacent drying cylinders. Each reversing roll is preferably a suction roll. The web is supported on the endless support belt such that the web directly contacts each of the drying cylinders while the endless support belt contacts the next reversing roll. The suction at the reversing roll helps hold the web to the support belt. Additionally, air blast means may be provided at the reversing roll to blow on the web passing over the reversing roll.

At least one, and preferably all, of the reversing rolls that are located between adjacent drying cylinders is supported in bearings. The bearings, in turn, are supported on guide elements which enable the position of each reversing roll with respect to the adjacent drying cylinders to be individually adjusted, particularly to adjust the space between the reversing roll and the preceding web delivering drying cylinder.

In the invention, the direction of movement of the reversing roll is at least approximately parallel to the central plane, which is a plane common to the axes of rotation of the two adjacent drying cylinders between which the reversing roll is disposed. The distance between the reversing roll and the web delivering drying cylinder can therefore be changed so that it remains without substantial effect on the drying wire tensioning device. In other words, there is substantially no adjustment of the wire tensioning roll needed. The reversing roll can therefore be displaced relatively rapidly. Furthermore, in case of need, several or even all of the reversing rolls of the dryer group can be displaced simultaneously. As in the case of the object of application WO 83/00514, the invention makes it possible, upon normal operation, to set an extremely small distance between the web delivering drying cylinder and the following reversing roll. This distance may amount to as little as about 5 mm to 25 mm. The distance is determined substantially by the thickness of the wire seam by which the support belt or drying wire is made endless. Due to this extremely small distance in normal operation, there is very great assurance that the paper web will firmly adhere to the support belt when the web moves off the web delivering drying cylinder. This assures that no substantial elongation or tensile stressing of the paper web and thus also no transverse contraction thereof takes place at this point. It is self evident that, in order to obtain this result, it is also necessary to produce a vacuum on the periphery of the reversing roll, for instance, by forming the reversing roll as a suction roll.

BRIEF DESCRIPTION OF THE DRAWING

Other objects and features of the invention and an illustrative embodiment are explained below with reference to the accompanying drawing. The drawing diagrammatically shows a side view of a single wire dryer group.

DESCRIPTION OF A PREFERRED EMBODIMENT

The dryer group shown in the drawing is part of a papermaking machine. The rest of that machine is not illustrated. The paper web 9 to be dried is shown in part as a dotted line. The web travels from left to right in the drawing through the dryer group. The dryer group comprises four upper heatable conventional paper web drying cylinders 11–14 and four lower reversing rolls 21–24, which are developed as suction guide rolls. A paper web guide roll 8 transfers the web of paper 9 from the outlet end of a press section (not shown) onto an endless support belt 10, which is preferably developed as a drying wire. The support belt first travels over a belt guide roll **19*b* which, if necessary, can also be developed as a suction roll. From here the paper web 9 travels, together with the support belt 10, along a meandering pathway through the dryer group, i.e. alternately over one of the dryer cylinders 11–14 and then over the neighboring one of the reversing rolls 21–24. From the last reversing roll 24, the support belt 10 travels over several normal belt guide rolls 19 and over a movable belt tensioning roll 19*a* back to the first belt guide roll 19*b*. Only a small portion of a support belt 20 and a part of a receiving suction roll 25** of the following dryer group are visible.

At the point of departure of the web and the support belt from each drying cylinder 11–14, there is a very short distance A (between 5 mm and 25 mm) between the periphery of the drying cylinder and the periphery of the adjacent reversing roll. This distance can be adjusted during normal operation. The shortness of this distance and the vacuum in the perforated reversing roll together help to assure that the web 9 does not remain adhering to the surface of the dryer cylinder, but rather directly follows the support belt 10 off the cylinder.

Each of the reversing rolls 21–24 can be provided with a conventional stationary inner suction box, or with a stationary outer suction box according to U.S. Pat. No. 4,202,113, or can be completely without stationary suction boxes, as in German Patent Application P 40 08 434.5, which corresponds to U.S. application No. 534,119 filed June 6, 1990.

As is customary, a scraper 40 for removing any remaining web material is provided on the free part of the surface of each drying cylinder.

Air blast boxes 38 are provided on some of the reversing rolls, e.g. 22 and 23. Each air blast box comprises a blast chamber 36 and a suction chamber 37 arranged after the chamber 36 with respect to the direction of travel of the web. That suction chamber 37 removes moist air. Each air blast box surrounds the adjacent reversing roll over about one-quarter of its periphery in the second half of the zone that is wrapped by the support belt 10. For this reason, each of the reversing rolls 21–23 is arranged asymmetrically with respect to the two adjacent drying cylinders between which the reversing roll is disposed during normal operation. Each reversing roll, for instance 22, and the two adjacent drying cylinders, for instance 12 and 13, can be referred to as a "roll set" which comprises a "web delivering cylinder" 11 upstream or before and a "web receiving cylinder" 13 downstream or after the reversing roll.

As mentioned above, a very small distance A is present between the web delivering cylinder and the following reversing roll 22. On the other hand, the distance B between the reversing roll and the following web receiving cylinder is substantially greater than the distance A, namely about 0.1 m to 0.5 m. This asymmetrical placement of the reversing roll between the adjacent drying cylinders has several advantages. On the one hand, space is provided for the above mentioned relatively large air blast box 38 alongside the scraper 40 and the distance necessary for guiding the air still remains between these two parts. Furthermore, there is also the required spacing between the air blast box 38 and the web receiving cylinder 13. Furthermore, a zone in which water vapor can emerge from the web of paper is also provided between the reversing roll 22 and the web receiving cylinder 13. The same benefit applies to all reversing rolls 11–14, regardless of whether an air blast box is present there.

As shown by the example of the reversing roll 22, each of the reversing rolls 21–24 rests in displaceable bearings 26. The direction of displacement of these bearings is parallel to the central plane M joining the central rotation axes of at least the two drying cylinders 12 and 13 adjacent the roll 22 and possibly all of the drying cylinders if they are arrayed in the illustrated horizontal row. This central plane M is determined by the axes of rotation of the drying cylinders. As diagrammatically indicated, the bearings 26 are linearly displaceable and rest on stationary linear guide elements 27. The bearings are displaceable by the action of the pressure fluid cylinders 28. Instead of the linear guide elements 27, swing levers (not shown) can also be provided, with swing bearings arranged below the reversing roll, so that the direction of movement of the bearings 26 is again substantially parallel to the central plane M.

The pressure fluid cylinders 28 can be activated automatically from a control center 30 via a system of conduits 29, shown only diagrammatically. They are activated particularly in case of a disturbance in operation, for instance, if the web of paper should tear. In that case, the reversing rolls 21–24 are pushed forward out of their positions shown in solid line, with the extremely small spacing A, into a position shown in dash-dot lines at reversing roll 21, in which the distance A is increased to approximately between 50 mm and 200 mm. In other words, the reversing rolls 21–23 lying between the drying cylinders 11–14 can be brought into a position which is approximately symmetrical between the adjacent cylinders. Upon a tear in the web of paper, there is a danger of the paper web unintentionally winding up on one of the drying cylinders. The above noted shifting of the reversing rolls avoids damage to the drying cylinders, or to the reversing rolls or to their bearings.

The above noted temporarily increased distance A is also of advantage when the support belt 10 must be replaced with a new one after a certain period of use. Upon the introduction of the new support belt, the belt is not yet endless. To one end of the support belt, there is fastened a lath or bar by means of which the support belt can then be introduced over the drying cylinders 11–14, over the reversing rolls 21–24 and over the other guide rolls. The rod or lath is then removed from the support belt, and the two ends of the belt are connected together so as to make the support belt endless. The enlarged distance A is therefore sufficiently large during the introduction of the support belt in order to be able to guide the bar or lath through its path between the outer surfaces of the drying cylinders and the reversing rolls.

In the arrangement shown, as seen in cross section, the roll side edge of the blast chamber 36 of the air blast box 38 extends approximately parallel to the direction of displacement of the anti-friction bearings 26. This enables a relatively small distance to be provided between the blast chamber 36 and the outer surface of the reversing roll 23. On the other hand, the distance between the outside of the reversing roll and the suction chamber 37 is relatively large during normal operation. As a result, the air blast box 38 can retain its position upon displacement of the reversing roll 23 into the position shown in dash-dot line. As a variant, however, it is also possible to swing the air blast box 38 in a known manner downward before the displacement of the reversing rolls 22 and 23.

In the dryer group shown, all of the drying cylinders lie in a horizontal row of cylinders. The invention, however, is also applicable in drying ends or dryer groups with vertical rows of cylinders similar, for instance, to the object of German Utility Model G 89 06 273, which corresponds to U.S. application No. 442,547, filed Nov. 28, 1989.

Although the present invention has been described in connection with a preferred embodiment thereof, many other variations and modifications will now become apparent to those skilled in the art. It is preferred, therefore, that the present invention be limited not by the specific disclosure herein, but only by the appended claims.

What is claimed is:

1. A single wire drying group for a machine for producing a fibrous web of paper, comprising:

a plurality of heatable drying cylinders having axes; a respective reversing roll associated with each of the drying cylinders;

an endless web support belt for supporting the web; the drying cylinders and the reversing rolls being respectively so positioned and the support belt being passed over the drying cylinders and the reversing rolls such that the endless support belt travels together with the web to be dried over one of the drying cylinders, then over one of the reversing rolls, and then over another of the drying cylinders;

at least a first one of the reversing rolls has before it in the path of the endless belt a first web delivering one of the drying cylinders and has after it in the path of the endless belt a second web receiving one of the drying cylinders;

movable bearing means for supporting the first reversing roll and for enabling the first reversing roll to be movable with respect to the first web delivering drying cylinder for selectively varying the distance between the reversing roll and the first web delivering drying cylinder, the bearing means supporting the first reversing roll for movement in directions at least approximately parallel to a central plane determined by the axes of the first web delivering and the second web receiving drying cylinders.

2. The single wire drying group of claim 1, further comprising additional guide rolls for tensioning and completing the path of the endless support belt so that the endless support belt passes over the drying cylinders and the reversing rolls and then passes over the guide rolls in the endless pathway of the support belt.

3. The single wire drying group of claim 2, wherein the additional guide rolls for the support belt include a tension roll about which the support belt passes and the tension roll being movable with respect to the other guide rolls for adjusting the tension on the support belt; the first reversing roll being movable in a direction such that the wire tensioning roll need not be moved upon displacement of the first reversing roll.

4. The single wire drying group of claim 1, wherein the drying cylinders and the reversing rolls are respectively so placed that there is one of the reversing rolls between two of the drying cylinders in the path of the endless support belt, the drying cylinders and the reversing rolls being so placed that the endless support belt passes alternately over one of the drying cylinders, then over the reversing roll and then over the next drying cylinder in the path of the endless support belt.

5. The single wire drying group of claim 4, wherein the endless support belt passes over the drying cylinders and the reversing rolls and the belt also supports the web on a side of the web such that the web on the support belt comes into direct contact with the drying cylinders while the support belt comes into direct contact with the reversing rolls.

6. The single wire drying group of claim 4, wherein there is a single one of the reversing rolls between each two adjacent ones of the drying cylinders in the path of the endless support belt.

7. The single wire drying group of claim 1, wherein each of the reversing rolls is also a suction roll.

8. The single wire drying group of claim 1, further comprising linear guide elements extending at least approximately parallel to the central plane and the bearing means of at least the first reversing roll rest in the linear guide elements for the bearing means to be movable at least approximately parallel to the central plane.

9. The single wire drying group of claim 7, further comprising a selectively operable stroke device connected with the bearing means of at least the first reversing roll, the stroke device being means for increasing the distance between the reversing roll and the preceding web delivering drying cylinder upon the occurrence of a predetermined signal.

10. The single wire drying group of claim 1, further comprising a selectively operable stroke device connected with the bearing means of at least the first reversing roll, the stroke device being means for increasing the distance between the reversing roll and the preceding web delivering drying cylinder upon the occurrence of a predetermined signal.

11. The single wire drying group of claim 1, wherein at least the first reversing roll is normally positioned at a first smaller distance from the preceding web delivering drying cylinder and at a second larger distance from the following web receiving drying cylinder and the distance of the reversing roll from the first web delivering drying cylinder is variable from that normal position.

12. The single wire drying group of claim 11, wherein for each of the reversing rolls, the preceding drying cylinder in the path of the endless support belt is a web delivering drying cylinder and the following drying cylinder in the path of the support belt is a web receiving drying cylinder such that after the first drying cylinder in the path of the support belt and before the last of the drying cylinders in the path of the support belt, each of the drying cylinders serves as a web receiving drying cylinder for the reversing roll preceding it and as a web delivering drying cylinder for the reversing roli following it in the path of the support belt.

13. The single wire drying group of claim 1, wherein outside the path of the support belt wrapping around each of the drying cylinders, a scraper is associated with each of the drying cylinders for scraping the surface of the drying cylinder.

14. The single wire drying group of claim 1, wherein the drying cylinders are arrayed in a generally horizontal row.

15. The single wire drying group of claim 1, further comprising air blast means associated with at least the first reversing roll for delivering an air blast at the web on the support passing the reversing roll.

16. The single wire drying group of claim 15, wherein the air blast means extends partly into the space between the reversing roll and the web receiving drying cylinder and not into the smaller space between the web delivering drying cylinder and the reversing roll.

17. The single wire drying group of claim 16, further comprising a selectively,,operable stroke device connected with the bearing means of at least the first reversing roll, the stroke device being means for increasing the distance between the reversing roll and the preceding web delivering drying cylinder upon the occurrence of a predetermined signal

18. The single wire drying group of claim 4, wherein for each of the reversing rolls, the preceding drying cylinder in the path of the endless support belt is a web delivering drying cylinder and the following drying cylinder in the path of the support belt is a web receiving drying cylinder such that after the first drying cylinder in the path of the support belt and before the last of the drying cylinders in the path of the support belt, each of the drying cylinders serves as a web receiving drying cylinder for the reversing roll preceding it and as a web delivering drying cylinder for the reversing roll following it in the path of the support belt;

the drying cylinders and the bearing means therefor being arrayed in a row, and the drying cylinders having axes of rotation which together define the central plane.

19. The single wire drying group of claim 18, wherein the drying cylinders are arrayed in a generally horizontal row.

20. A single wire drying group for a machine for producing a fibrous web of paper, comprising:

a plurality of heatable drying cylinders having axes; a respective reversing roll associated with each of drying cylinders; the drying cylinders and the reversing rolls being respectively so positioned that an endless support belt may be passed over the drying cylinders and the reversing rolls such that the endless support belt travels together with the web to be dried over one of the drying cylinders, then over one of the reversing rolls, and then over another of the drying cylinders;

at least a first one of the reversing rolls has before it in the path of the endless belt a first web delivering one of the drying cylinders and has after it in the path of the endless belt a second web receiving one of the drying cylinders;

movable bearing means for supporting the first reversing roll and for enabling the first reversing roll to be movable with respect to the first web delivering drying cylinder for selectively varying the distance between the reversing roll and the first web delivering drying cylinder, the bearing means supporting the first reversing roll for movement in directions at least approximately parallel to a central plane determined by the axes of the first web delivering and the second web receiving drying cylinders.

* * * * *